US009672996B2

(12) United States Patent
Ardyna et al.

(10) Patent No.: US 9,672,996 B2
(45) Date of Patent: Jun. 6, 2017

(54) CONTROL DEVICE OF THE SPRING TYPE PARTICULARLY FOR A HIGH-VOLTAGE OR MEDIUM-VOLTAGE CIRCUIT BREAKER OR SWITCH

(71) Applicant: ALSTOM Technology Ltd, Baden (CH)

(72) Inventors: Simon Ardyna, Habsheim (FR); Ernst Suter, Kolliken (CH); Peter Von Allmen, Buchs (CH)

(73) Assignee: ALSTOM TECHNOLOGY LTD, Baden (CH)

( * ) Notice: Subject to any disclaimer, the term of this patent is extended or adjusted under 35 U.S.C. 154(b) by 0 days.

(21) Appl. No.: 14/646,103

(22) PCT Filed: Nov. 27, 2013

(86) PCT No.: PCT/EP2013/074876
§ 371 (c)(1),
(2) Date: May 20, 2015

(87) PCT Pub. No.: WO2014/083064
PCT Pub. Date: Jun. 5, 2014

(65) Prior Publication Data

US 2015/0325386 A1 Nov. 12, 2015

(30) Foreign Application Priority Data

Nov. 28, 2012 (FR) ..... 12 61348

(51) Int. Cl.
*H01H 5/00* (2006.01)
*H01H 3/38* (2006.01)
(Continued)

(52) U.S. Cl.
CPC ..... *H01H 3/38* (2013.01); *H01H 3/30* (2013.01); *H01H 3/3005* (2013.01);
(Continued)

(58) Field of Classification Search
CPC .. H01H 1/00; H01H 1/12; H01H 1/14; H01H 3/00; H01H 3/02; H01H 3/30;
(Continued)

(56) References Cited

U.S. PATENT DOCUMENTS 4,491,709 A * 1/1985 Chabot ..... H01H 3/3021 200/288
4,587,390 A * 5/1986 Gray ..... H01H 33/666 200/400
(Continued)

FOREIGN PATENT DOCUMENTS

JP 2007242597 A 9/2007
WO 2007016883 A1 2/2007
WO 2008117437 A1 10/2008

OTHER PUBLICATIONS

International Search Report and Written Opinion for PCT Application No. PCT/EP2013/074876 mailing date Jan. 8, 2014.
(Continued)

*Primary Examiner* — Anthony R. Jimenez
(74) *Attorney, Agent, or Firm* — Nixon Peabody, LLP; Khaled Shami

(57) ABSTRACT

The control device possesses a rigid main part combining most of the functional elements of this type of control device. It is made up of two portions of a rotary shaft, having placed between them a cam and a support arm that are connected together by a pivot that is offset relative to the axis of rotation. A toothed wheel having an inner set of teeth is placed around the support arm that is provided with a rachet system. The toothed wheel has an outer set of teeth-driven by a motor, via an intermediate gearwheel. The pivot controls the compression of the actuator spring by the assembly rotating. The device is applicable to high and medium voltage circuit breakers and switches.

3 Claims, 2 Drawing Sheets

(51) Int. Cl.

| | |
|---|---|
| ***H01H 3/30*** | (2006.01) |
| ***H01H 3/42*** | (2006.01) |
| ***H01H 3/34*** | (2006.01) |
| ***H01H 3/40*** | (2006.01) |

(52) U.S. Cl.
CPC ..... *H01H 3/3015* (2013.01); *H01H 3/3021* (2013.01); *H01H 3/3031* (2013.01); *H01H 3/34* (2013.01); *H01H 3/40* (2013.01); *H01H 3/42* (2013.01)

(58) Field of Classification Search
CPC ..... H01H 3/3031; H01H 3/32; H01H 3/34; H01H 3/40; H01H 3/38; H01H 3/42; H01H 3/46; H01H 3/54; H01H 3/58; H01H 71/00; H01H 71/10; H01H 2003/00; H01H 2003/02; H01H 2003/30; H01H 2003/3031; H01H 2003/32; H01H 2003/40; H01H 2003/46; H01H 5/00; H01H 3/3005; H01H 3/3015; H01H 3/3021; H01H 33/40
USPC ..... 200/400, 19.01, 19.03, 19.07, 19.13, 200/19.18, 19.19, 19.2, 410, 411, 416, 200/419, 424, 430, 501; 74/10.29, 108, 74/63, 70, 75, 89.34, 116, 111, 216.3, 74/318, 457, 567, 579 R, 592, 575, 577 S, 74/577 R
See application file for complete search history.

(56) References Cited

U.S. PATENT DOCUMENTS

| | | | |
|---|---|---|---|
| 4,596,310 | A | 6/1986 | Hatakeyama et al. |
| 5,280,258 | A | 1/1994 | Opperthauser |
| 2005/0146814 | A1 | 7/2005 | Sellier et al. |
| 2009/0201617 | A1 | 8/2009 | Yamaguchi |
| 2010/0006544 | A1 | 1/2010 | Onufriyenko et al. |

OTHER PUBLICATIONS

Preliminary French Search Report for FR Application No. FR12 61348 dated Apr. 6, 2013.

* cited by examiner

CONTROL DEVICE OF THE SPRING TYPE PARTICULARLY FOR A HIGH-VOLTAGE OR MEDIUM-VOLTAGE CIRCUIT BREAKER OR SWITCH

CROSS-REFERENCE TO RELATED PATENT APPLICATION

The present application is a National Stage Application of International Application No. PCT/EP2013/074876 entitled "CONTROL DEVICE OF THE SPRING TYPE PARTICULARLY FOR A HIGH-VOLTAGE OR MEDIUM-VOLTAGE CIRCUIT BREAKER OR SWITCH" filed Nov. 27, 2013, which claims priority to French Patent Application Number 12 61348 filed Nov. 28, 2012, the contents of which are incorporated herein by reference in their entirety.

FIELD OF THE INVENTION

The invention relates to an actuator assembly, also known as a "control mechanism", of the type in which energy is accumulated in one or more springs, commonly referred to as a "spring control mechanism" for a high or medium voltage circuit breaker or switch, and including a freewheel coupling device, i.e. a rachet system.

PRIOR ART AND PROBLEM POSED

Spring type control devices exist for high or medium voltage switches and circuit breakers, in particular for circuits breakers and switches for gas insulated switchgear (GIS). These types of control device use energy, such as torque, for closing and opening the movable contacts of the switch or circuit breaker device. Three technologies are used in this type of control device: hydraulic devices; pneumatic devices; and spring devices. The present invention relates to spring type devices. The invention is therefore applicable in gas insulated installations (GIS), but may be applied equally well to air insulated installations, and also to indoor or outdoor installations.

The technique concerned by the control device of the invention combines a rachet system for loading a spring, i.e. a freewheel system, with a cam system for controlling the switch or the circuit breaker.

Patent document WO 2008/117437 A1 describes an energy accumulator device of the spring type for switchgear. In that type of device, a motor is coupled to a closure spring 22 via a gearwheel 16, an intermediate gearwheel 33, and a primary toothed wheel 5. The closure spring 22 is connected to the primary toothed wheel 5, which is made up of three coaxial gearwheels A, B, and C. The gearwheel B has an outer set of teeth 35 over its entire periphery, whereas the gearwheels A and C are provided with respective sets of teeth 34*a* and 34*b* over only respective fractions of a circular arc. While the closure spring is being loaded, the motor 3 drives the toothed wheel 16 in the clockwise direction. It therefore drives the intermediate toothed wheel 33 in the opposite direction. This intermediate toothed wheel 33 meshes with the primary toothed wheel 5. When the closure spring 22 is fully loaded, the toothless section 34 ensures that the intermediate toothed wheel 33 and the toothed wheel 16, together with the motor 3, no longer turn together with the gearwheel A. The toothless section 34 decouples the motor 3 from the gearwheel A and prevents the motor from being damaged as a result of the system being constrained to stop.

A rachet system having pawls 41*a*, 41*b* is used on the gearwheel C and co-operates with the inner teeth 36 of the gearwheel B. When the closure spring is fully loaded, the gearwheel C stops turning because of its non-toothed section 34*b*. Nevertheless, the gearwheel B, driven by the pawls 41*a*, 41*b*, is no longer engaged with the inner set of teeth of the gearwheel B.

The closure operation of the device may thus take place by the closure spring 22 relaxing.

That solution requires at least two gearwheels A and B to be used in combination in order to load the closure spring 22 and to drive the movable contacts of the switch. The gearwheel A is needed because of its non-toothed section 34*a* that serves to allow the gearwheel A to stop on reaching dead-center, with the closure spring being fully loaded. The gearwheel B is needed for driving the movable contacts.

With that solution, the closure operation is relatively slow because of the need for the gearwheels A and B, the intermediate toothed wheel 33, and the rachet system to operate simultaneously.

It should also be observed that patent document U.S. Pat. No. 4,491,709 also describes a spring control system using a rachet system for switch applications.

In all of the devices proposed, the overall size of the devices is not negligible. Unfortunately, there is a need to be able to have control devices that are relatively compact. This is particularly advantageous for gas insulated switches of the kind frequently installed in built-up areas, where space is limited. Furthermore, there is a need to limit the number of mechanical moving parts that make up such a control system in order to avoid risks of failure in the mechanism. Furthermore, that can also improve the compactness of the device.

SUMMARY OF THE INVENTION

To this end, the invention mainly provides a spring type control device comprising:

- a spring for rapidly delivering energy in order to move a movable contact of a circuit breaker or a switch;
- a rotary shaft for transmitting the energy needed for loading the spring;
- a toothed wheel receiving the energy via an outer set of teeth and serving to drive the rotary shaft while loading the spring;
- a rachet system for coupling and uncoupling the toothed wheel and the rotary shaft;
- a cam secured to the rotary shaft for transmitting the energy delivered by the spring to the movable contact;
- a support arm secured to the rotary shaft and carrying a rachet system, with the toothed wheel being placed around the spring arm; and
- a pivot fastened to the arm, the pivot being axially offset relative to the rotary shaft and mechanically connected to the spring.

According to the invention, the rotary shaft, the cam, the support arm, and the pivot form a single crankshaft-shaped part, the pivot being placed in the middle of this set of parts, between the support arm and the cam, the pivot being connected to one end of the spring by a loading rod having its other end mounted to pivot on the pivot, like a connecting rod, the rotary shaft comprising two portions, one beside the cam and the other beside the support arm.

In a main embodiment of the invention, the support arm has at least three angularly offset branches, with peripheral surfaces supporting the toothed wheel by making contact with the tips of teeth of the inner set of teeth of the toothed wheel, the rachet system being placed on one of the branches of the support arm to co-operate with the inner set of teeth of the toothed wheel.

Two other main aspects of the invention are a circuit breaker and a switch making use of the above-described device.

LIST OF FIGURES

The invention and its various technical characteristics can be better understood on reading the following description that is accompanied by four figures, in which, respectively:

DETAILED DESCRIPTION OF AN EMBODIMENT OF THE INVENTION

Figure 1:
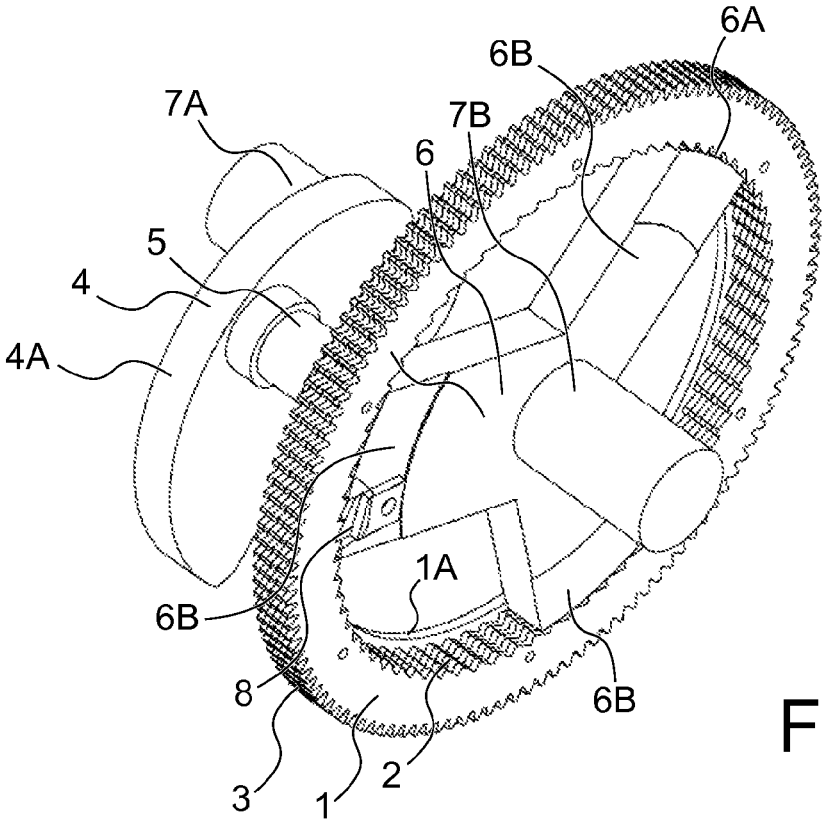
FIG. 1 is a perspective view of a large portion of the device of the invention.

FIG. 1 shows a device of the invention without the energy-supply spring and the loading connecting rod that connects the spring to the elements shown in FIG. 1. Among the main elements shown in this figure, there is a toothed wheel 1, having an inner set of teeth 2 and an outer set of teeth 3. The outer set of teeth 3 serves to receive energy for loading the spring, e.g. as delivered by a motor via a toothed gearwheel (not shown) that meshes with the outer set of teeth 3 of the toothed wheel 1. FIG. 1 also shows a cam 4 having a functional outside surface 4A that is used to actuate the movable contact(s) of the electrical installation for engaging or disengaging. The cam 4 is connected via a pivot 5 constituted by a shaft segment to a support arm 6 placed inside the toothed wheel 1. One of the functions of the support arm 6 is to support the wheel. In the embodiment shown in FIG. 1, the support arm 6 is in the form of a star having three branches 6B, but that is merely an example, and embodiments with four branches 6B or even more could also be envisaged. The outside surface 6A of the support arm 6 must be capable of being in contact with the tips of the teeth of the inner set of teeth 2 of the toothed wheel 1.

On either side of the assembly constituted by these four elements, there is the rotary shaft of the device in two portions 7A and 7B. These two portions 7A and 7B are coaxial and they are designed to be supported by bearings. The pivot 5 is offset axially from the rotary shaft 7A, 7B.

It can thus be seen that the rotary shaft 7A, 7B, the cam 4, the pivot 5, and the support arm 6 are constituted and fabricated as a single part. This unit has the general shape of a crankshaft. Naturally, the various elements making up this unit are prevented from moving relative to one another.

Beside the toothed wheel 1, there can be seen an inner rim 1A extending around the entire circumference of the toothed wheel 1. This enables the wheel to be positioned relative to the arm 6 of overall diameter greater than the inside diameter of the lateral rim 1A.

The pivot 5 serves to connect the unit shown in FIG. 1 mechanically to one or more springs for delivering the energy needed for opening or closing the electrical installation. In order to simplify the depiction of the embodiment, no spring is shown in FIG. 1. Nevertheless, the pivot 5 serves to communicate the energy transmitted by the set of elements shown in FIG. 1 to a compression spring via a connecting rod that is likewise not shown.

A pawl 8 pivotally mounted on one end of a branch 6B of the support arm 6 co-operates with the inner set of teeth 2 of the toothed wheel 1 to form a rachet system. The end of the pawl 8 thus penetrates between two teeth of the inner set of teeth 2 of the toothed wheel 1. When the wheel turns clockwise, the pawl 8 is engaged between two teeth of the inner set of teeth 2 of the toothed wheel 1. Under such circumstances, both portions 7A and 7B of the rotary shaft, the support arm 6, and the cam 4 turn by the same amount in the clockwise direction together with the toothed wheel 1.

In contrast, if the support arm 6 turns clockwise, the pawl 8 tends to disengage from the inner set of teeth 2 of the toothed wheel 1. Thus, the assembly secured to the support arm 6 no longer transmits any mechanical moment or energy to the toothed wheel 1.

The presence of a rachet system is needed for loading the spring. This stage of loading the spring is performed by means of an electric motor driving the toothed wheel 1 clockwise by means of an auxiliary wheel (not shown). Still while loading the spring, the pawl thus remains engaged between two teeth of the inner set of teeth 2 of the toothed wheel 1 and all of the elements shown in FIG. 1 turn together clockwise. Thus, the pivot 5 can transmit to the connecting rod the movement that serves to compress the closure spring.

While it is loading the closure spring, when this turning assembly reaches bottom dead-center, i.e. when the connecting rod is in alignment with the closure spring, the spring relaxes. It then drives the pivot 5 and the support shaft in the same direction of rotation as before, but at a very much greater speed. As a result of this acceleration in the rotation of the support arm, the pawl 8 disengages from the teeth of the inner set of teeth 2 of the wheel 1. The wheel 1 is therefore not driven in rotation and does not transmit a jolt to the drive motor.

Figure 2:
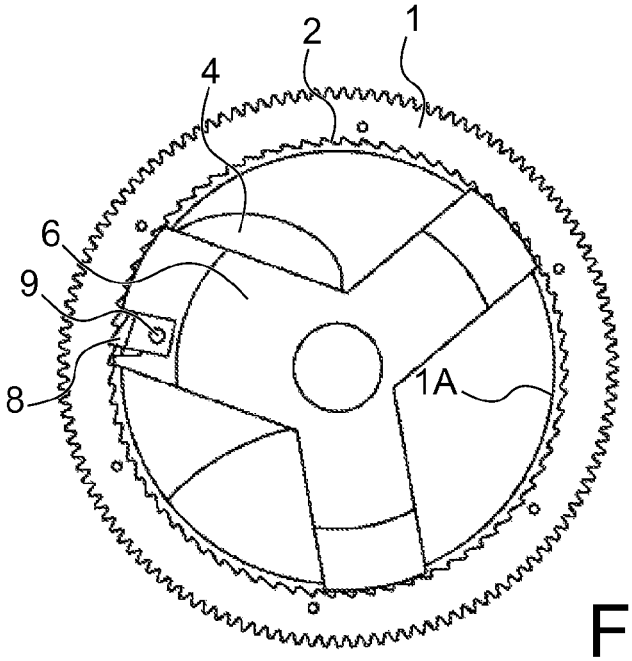
FIG. 2 is a face view of a portion of the device of the invention, seen from beside the toothed wheel.

FIG. 2 shows more clearly the support arm 6 with the rachet device and the toothed wheel 1, which wheel is placed around the support arm.

The rachet system operates as follows. The pawl 8 is mounted to pivot at one end of a branch of the support arm 6, by means of a small pivot pin 9. By means of this pivoting connection, the pawl 8 can occupy two positions. In FIG. 2, the position shown is the position in which the pawl 8 is engaged between two teeth of the inner set of teeth 2 of the toothed wheel 1. In this position, the support arm 6 and the toothed wheel 1 turn together. The second position is the position in which the pawl 8 has been able to pivot about its pivot axis 9 in the counterclockwise direction. In this second position, the pawl 8 is disengaged from the teeth of the inner set 2 of the toothed wheel 1. As a result, the support arm 6 and the toothed wheel 1 can turn separately relative to each other without transferring force or mechanical moments between each other.

FIG. 2 also shows the cam 4 and the inner rim 1A of the toothed wheel 1.

Figure 3:
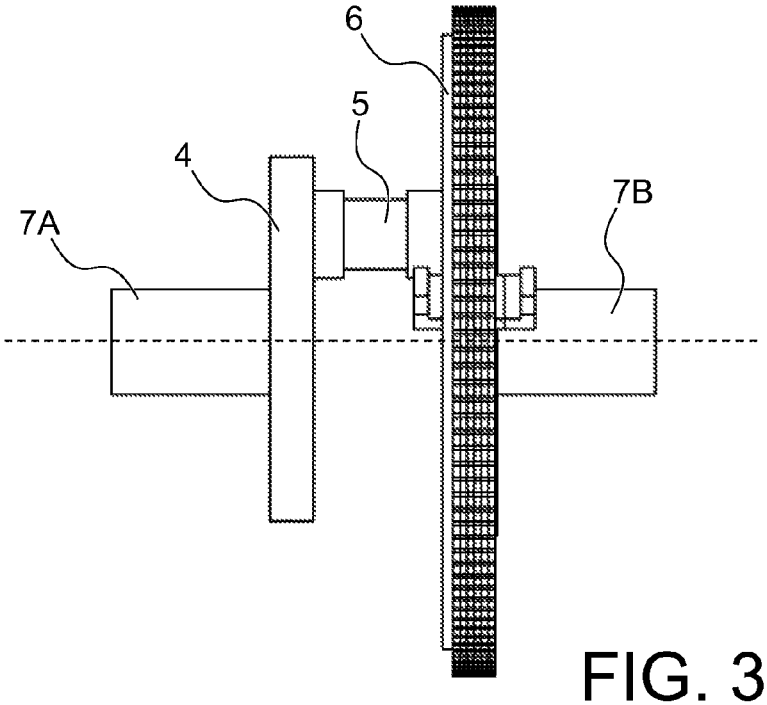
FIG. 3 is a side view of a large portion of the device of the invention.

FIG. 3 shows clearly the crankshaft shape of a large portion of the elements of the device that constitutes a single mechanical part, i.e. the two portions 7A and 7B of the rotary shaft, the cam 4, the pivot 5, and the support arm 6.

The pivot 5, which is placed between the cam 4 and the support arm 6, is offset axially relative to the rotary shaft 7A, 7B. It can thus be seen that during a rotation of the rotary shaft 7A and 7B, the position of the pivot 5 relative to an axis perpendicular to the axis of FIG. 3 varies. This position variation corresponds to the variation in the compression of the closure spring.

Figure 4:
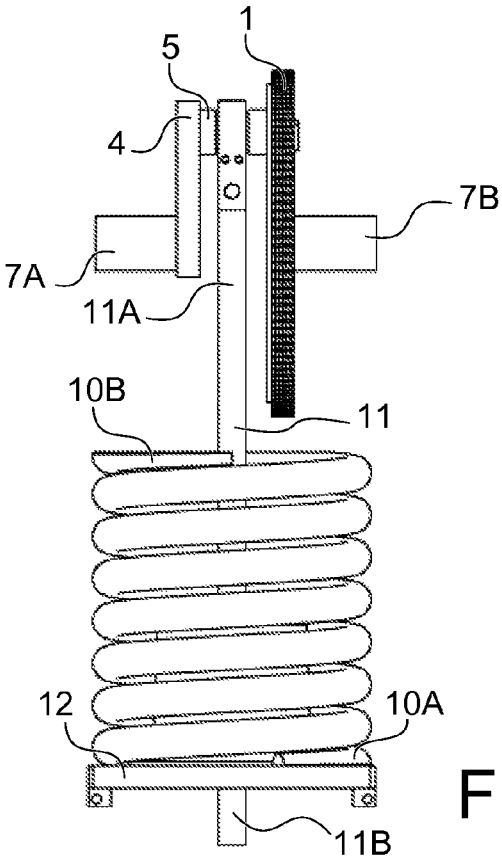
FIG. 4 is a side view of the device of the invention shown in full.

FIG. 4 reproduces the assembly shown in FIG. 3, i.e., the rotary shaft 7A, 7B, the cam 4, the pivot 5, and the support arm hidden by the toothed wheel 1. A connecting rod 11 is pivotally mounted on the pivot 5 at a first end 11A. It is connected at a second end 11B to a plate 12 having a first end 10A of the closure spring 10 placed thereon, which spring in this type of embodiment is a helical spring. It should be observed that the second end 10B of the spring 10 is stationary.

It can easily be understood that during one rotation of the rotary shaft 7A, 7B, the position of the pivot 5 relative to a plane perpendicular to the plane of FIG. 4 and containing the axis of rotation of the rotary shaft 7A, 7B, varies. Rotation in either direction of the rotary shaft 7A, 7B enables the pivot 5 to rise relative to FIG. 4, thereby compressing the closure spring 10 by raising the plate 12 on which the spring is placed.

Advantages of the Invention

Thus, the control device of the invention proposes combining in a single rigid element the cam 4, the pivot 5, the support arm 6, and its rachet system, together with the rotary shaft 7A, 7B. The various mechanical elements used in prior art devices, such as, for example: a transmission chain between the control system and the spring are avoided. This leads to a much smaller risk of failure and to an assembly that is more compact.

The invention claimed is:

1. A spring type control device comprising:

a spring for delivering energy in order to move a movable contact of a circuit breaker or a switch;

a rotary shaft for transmitting energy needed for loading the spring;

a toothed wheel receiving the energy delivered by the spring via an outer set of teeth and designed to drive the rotary shaft while loading the spring;

a ratchet system for coupling and uncoupling the toothed wheel and the rotary shaft;

a cam secured to the rotary shaft for transmitting the energy delivered by the spring to the movable contact of the circuit breaker or switch;

a support arm secured to the rotary shaft and carrying the ratchet system and around which the toothed wheel is placed; and a pivot fastened to the support arm, being axially offset relative to the rotary shaft and mechanically connected to the spring;

wherein the rotary shaft, the cam, the support arm, and the pivot constitute a single part in the form of a crankshaft, the pivot being placed centrally between the cam and the support arm, the pivot being connected to a first end of the spring by a connecting rod, the connecting rod having a first end pivotally connected on the pivot and having a second end connected to the first end of the spring, the rotary shaft being made up of two portions, one of the portions beside the cam and the other portion beside the support arm.

2. A spring type control device comprising:

a spring for delivering energy in order to move a movable contact of a circuit breaker or a switch;

a rotary shaft for transmitting energy needed for loading the spring;

a toothed wheel receiving the energy delivered by the spring via an outer set of teeth and designed to drive the rotary shaft while loading the spring;

a ratchet system for coupling and uncoupling the toothed wheel and the rotary shaft;

a cam secured to the rotary shaft for transmitting the energy delivered by the spring to the movable contact of the circuit breaker or switch;

a support arm secured to the rotary shaft and carrying the ratchet system and around which the toothed wheel is placed; and a pivot fastened to the support arm, being axially offset relative to the rotary shaft and mechanically connected to the spring, wherein the rotary shaft, the cam, the support arm, and the pivot constitute a single part in the form of a crankshaft, the pivot being placed centrally between the cam and the support arm, the pivot being connected to a first end of the spring by a connecting rod, the connecting rod having a first end pivotally connected on the pivot and having a second end connected to the first end of the spring, the rotary shaft being made up of two portions, one of the portions beside the cam and the other portion beside the support arm, and wherein the support arm possesses at least three angularly offset branches with peripheral surfaces supporting the toothed wheel by contacting the tips of teeth of an inner set of teeth, the ratchet system being placed on one of the branches to co-operate with the inner set of teeth of the toothed wheel.

3. A circuit breaker using a spring type system, comprising:

a spring for delivering energy in order to move a movable contact of a circuit breaker or a switch;

a rotary shaft for transmitting energy needed for loading the spring;

a toothed wheel receiving the energy delivered by the spring via an outer set of teeth and designed to drive the rotary shaft while loading the spring;

a ratchet system for coupling and uncoupling the toothed wheel and the rotary shaft;

a cam secured to the rotary shaft for transmitting the energy delivered by the spring to the movable contact of the circuit breaker or switch;

a support arm secured to the rotary shaft and carrying the ratchet system and around which the toothed wheel is placed; and a pivot fastened to the support arm, being axially offset relative to the rotary shaft and mechanically connected to the spring;

wherein the rotary shaft, the cam, the support arm, and the pivot constitute a single part in the form of a crankshaft, the pivot being placed centrally between the cam and the support arm, the pivot being connected to a first end of the spring by a connecting rod, the connecting rod having a first end pivotally connected on the pivot and having a second end connected to the first end of the spring, the rotary shaft being made up of two portions, one of the portions beside the cam and the other portion beside the support arm; and wherein the support arm possesses at least three angularly offset branches with peripheral surfaces supporting the toothed wheel by contacting the tips of teeth of the inner set of teeth, the ratchet system being placed on one of the branches to co-operate with the inner set of teeth of the toothed wheel.

* * * * *